United States Patent [19]

Smith

[11] 4,318,963

[45] Mar. 9, 1982

[54] TREATMENT OF CELLULOSIC MATERIALS

[76] Inventor: Richard D. Smith, 224 Early, Park Forest, Ill. 60466

[21] Appl. No.: 113,810

[22] Filed: Jan. 21, 1980

[51] Int. Cl.[3] ..... B44D 1/092; B05D 3/00; B05D 3/02; B05D 1/18

[52] U.S. Cl. ..... 428/537; 428/702; 252/385; 427/296; 427/316; 427/372.2; 427/421; 427/429; 427/439

[58] Field of Search ..... 427/395, 316, 326, 421, 427/439, 296, 372.2, 429; 252/198, 305, 382, 385; 428/537, 702

[56] References Cited

U.S. PATENT DOCUMENTS 3,676,182 7/1972 Smith ..... 427/316

3,939,091 2/1976 Kelly ..... 427/421 X 4,051,276 9/1977 Williams ..... 427/395 X

*Primary Examiner*—Michael R. Lusignan

*Attorney, Agent, or Firm*—Fitch, Even, Tabin, Flannery & Welsh

[57] ABSTRACT

This invention provides for improvement in the preservation of cellulosic materials through solubilization of a dried metal alkoxide, particularly magnesium methoxide, in an alcohol with the presence of carbon dioxide. The solution is applied to cellulosic materials by various known methods resulting in deacidification with improved aging properties imparted to the materials. The treated cellulosic materials have improved characteristics and printed materials do not blur or run.

6 Claims, No Drawings

TREATMENT OF CELLULOSIC MATERIALS

The present invention relates to an improvement on my "Treatment of Cellulosic Materials", U.S. Pat. No. 3,676,182, issued July 11, 1972, and relates generally to the treatment of cellulosic materials. More particularly, the invention relates to the treatment of cellulosic materials which may deteriorate or which may have become deteriorated through aging. Still more particularly, the invention is directed to the preservation of printed cellulosic materials, such as books and manuscripts, which through aging, have lost or may lose some of their initial physical properties.

An explanation of the ubiquity of this problem throughout the world, the vast quantities of irreplaceable records and books already and potentially lost, history and lack of total success of proposed alleviating treatments, and continuing need for further improvement is set forth in U.S. Pat. No. 3,676,182.

Despite the seriousness of the problem and extensive efforts toward solving it, as evidenced by my own patents, U.S. Pat. Nos. 3,676,055 and 3,676,182, and efforts by others as set forth in U.S. Pat. Nos. 3,698,925; 3,703,353; 3,771,958; 3,778,401; 3,837,804; 3,898,356; 3,939,091; and 3,969,549, a completely satisfactory solution to the problem of long-term preservation of cellulosic materials, and particularly a solution which is not harmful to all paper, pigments, or media of printed materials, or hazardous to users, has not yet been provided.

While claims have been made to provide adequate treatment measures, the fact is that practically all archives, museums, libraries, and collectors do not accept known methods as satisfactory because most institutions have not taken effective measures to prevent their collections from deterioration resulting from aging. As explained in my article, "Progress in Mass Deacidification at the Public Archives", *Canadian Library Journal*, December 1979, pp. 325–32, acid attack causes over ninety percent of this aging. Thus, from the viewpoint of inventors and practitioners, the evidence is clear that existing preventative measures are, at best, not completely acceptable.

Accordingly, it is a principal object of this invention to provide improved means for preserving cellulosic materials.

It is an additional object of this invention to preserve cellulosic materials on which printing, writing, or other recordings are rendered without destroying or impairing the fidelity of the image.

It is a still further object of this invention to provide means for preserving cellulosic materials for extended periods of time.

Another object of this invention is to provide a means for preserving cellulosic materials which includes use of benign preserving materials.

A further object of the invention is to provide an improved method of preserving books and paper which increases the durability and strength retention of such items; and which introduces a chemical having the capability of minimizing the effect of trace metal ions, e.g., iron and copper.

A further object of the invention is to provide a method for preserving properties of cellulosic materials but which also sanitizes or sterilizes the materials treated.

A further object of the invention is to provide a method which makes it practical for non-technicians to treat their personal memorabilia, books, records, and works of art with a low-cost, effective, convenient, long-lasting, benign preservation treatment that can be safely conducted without unusual hazards.

These objects are satisfied through development of new chemicals and new applications for chemicals and solutions. The magnesium alkoxides disclosed in U.S. Pat. No. 3,676,182 were effective and worked exceptionally well, but required strict control of moisture to attain the best results. This problem was alleviated to some degree as disclosed in the Kelly U.S. Pat. No. 3,939,091 through introduction of carbon dioxide to produce an adduct, viz., methoxy magnesium methyl carbonate (name used by *Chemical Abstracts* for methyl magnesium carbonate). The methoxy magnesium methyl carbonate has also been found to readily react with moisture, and initially produces difficult-to-see, elongated crystals with a similar index of refraction to the chlorofluorocarbon/methanol or methanol solvents disclosed by me. U.S. Pat. No. 3,939,091 teaches that a significant difference exists between magnesium methoxide and methoxy magnesium methyl carbonate in that a dried methoxy magnesium methyl carbonate is readily soluble while dried magnesium methoxide is insoluble. I have found that dried magnesium methoxide is readily dissolved in anhydrous methanol containing carbon dioxide. This is unexpected since the literature, as well as the Kelly Patent, teaches that magnesium methoxide forms an insoluble powder. This discovery provides improvement in manufacturing procedures, to production of laboratory chemicals on a commercial basis, and improved deacidification solutions, and leads to the satisfaction of the objects of this invention.

The hazardous and costly requirement to ship and handle 5 percent to 10 percent solutions of magnesium methoxide in methanol can be avoided by shipping the dried powder and dissolving it in methanol or chlorofluorocarbon/methanol or other suitable solvent in the presence of carbon dioxide, when need requires.

In addition to solubilizing dried magnesium methoxide I have found it possible to solubilize magnesium ethoxide, which is virtually insoluble in ethanol, through addition of carbon dioxide to produce the extremely soluble ethoxy magnesium ethyl carbonate.

By my method, the manufacture of difficult to produce or heretofore unavailable pure magnesium alkoxides without contamination from catalysts is now possible. For example, magnesium metal can be readily reacted with absolute methanol or ethanol and dried magnesium alkoxide produced by continuous or batch procedures. The dried magnesium alkoxide can be dissolved in an alcohol of choice, e.g., methanol, ethanol, or higher alcohol, when the alcohol contains carbon dioxide. The reaction will produce methoxy magnesium methyl carbonate, or its homolog, if a higher alcohol is selected. Purification, i.e., removal of the shorter carbon alcohol, can be achieved, if desired, by vacuum distillation.

The technique of converting insoluble magnesium methoxide into a higher alcohol magnesium alkoxide by exchange of magnesium for the hydrogen of an hydroxyl group, has utility beyond the lower alcohols and their higher molecular weight homologs. It can be applicable to other hydroxyl groups with the capability of exchanging their hydrogen for magnesium. Moreover, this application is not restricted to magnesium but can be extended to other metals and their alcohol group reactants. Combinations of metals and alcohols produce mixtures and/or solutions with various properties. These properties include depositing a buffering agent which produces a particular pH value to providing a solution with a specific viscosity or a particular metal combination. Through these properties there is provided the capability of buffered deacidification, controlled substrate penetration, or metal combinations giving special protection, e.g., protection against oxidative attack by the presence of magnesium and against fungus attack by the presence of zinc.

The solutions of this invention can be dried to give the metal alkoxide. Techniques of solvent removal and drying are known. Instructions for preparing dried alkoxides are disclosed in U.S. Pat. Nos. 2,287,088; 2,570,058 and 2,593,314. No special conditions are required to prepare the dried alkoxide powders. They may be pan-dried and pulverized, but I prefer to vacuum spray dry and produce a free flowing soft granular powder. The dried alkoxide powders can be dissolved in alcohol in the presence of carbon dioxide at room or lower or higher temperatures, and at ambient or higher or lower pressures depending upon equipment, safety regulations, and manufacturing conditions and objectives. The solution rate in the presence of carbon dioxide is accelerated by addition of heat.

The reaction can be conducted in presence of other noninterfering gases. The reaction can be conducted in glass or metal or other suitable vessels at ambient or lower or higher carbon dioxide pressure. The rate of reaction can be accelerated by preheating the carbon dioxide gas or introducing it through a gas diffusion stone to increase contact through maximizing bubble surface area. Any carbon dioxide introduction technique, such as higher pressure, which accelerates the reaction rate and heat production may require a cooling capability to prevent overheating.

Manufacturing techniques, e.g., reacting the magnesium metal with alcohol, can result in a grey tint in the dry powder and cause alkoxy magnesium alkyl carbonate solutions to appear black. This problem can be overcome through centrifugation, filtration, settling, flotation, and decantation. The tint or coloring can be tolerable in some circumstances.

Low concentration, e.g., below 5 percent, of methoxy magnesium methyl carbonate or methoxy magnesium ethyl carbonate, exhibit little change in viscosity from that of the pure solvent. At a higher level, e.g., 10 percent, the solution becomes somewhat oily. A molasses-like consistency results with continued concentration. An alternate way of controlling viscosity is to add controlled amounts of water. Care must be taken, when a free flowing liquid is desired, to insure that water is not introduced in such an amount as to cause the solution to gel.

Greater tolerance to the presence of water can be obtained by continued addition of carbon dioxide. Increased addition of carbon dioxide reduces the ability of water molecules to contact or react with the magnesium metal ion in the alkoxide molecule. The fully carbonated alkoxide is the stable form when the partial pressure of carbon dioxide exceeds one atmosphere.

The following Examples illustrate the practice of the invention.

EXAMPLE I

Four pounds of dried powdered magnesium methoxide was added to 20 liters absolute methanol in a glass carboy. Carbon dioxide was bubbled through the suspension for three hours with an air-powered stirrer used to accelerate redissolving of the powder. After allowing the extraneous matter to settle, the clear solution was decanted and diluted in the proportions: 1 part with 9 parts of trichlorotrifluoroethane. This solution was sprayed and brushed onto papers, and paper was dipped into the solution. The pH of the papers were raised from an acid pH to pH 10.5. The papers were preserved and had increased aging properties. The solution was benign and could be handled without hazard. Further, the papers were strengthened and images on the paper were retained without blurring or running of inks.

A portion of the solution was transferred to an aerosol can with addition of carbon dioxide to 50 psig. so that a fine mist-like spray was available on demand.

EXAMPLE II

Four and one-half pounds of dried powdered magnesium ethoxide was added to 20 liters of absolute ethanol in a stainless steel reactant vessel. Carbon dioxide was introduced until the pressure was 150 kPa. The suspension was agitated with a magnetic stirrer and additional carbon dioxide added as necessary to maintain 150 kPa. At the end of two hours, the vessel was opened and the magnesium ethoxide was found totally dissolved in a black liquid. The liquid was filtered and provided a colorless slightly thickened solution which produced results equivalent to those in Example I.

EXAMPLE III

Two quarts of the filtered liquid produced in Example II were added to six gallons of liquified dichlorodifluoromethane previously saturated with carbon dioxide. Five books, previously dried to equilibrium at 140° F. and 100 millitorr pressure, were equalized in pressure and immersed in the above dichlorodifluoromethane/-concentrate deacidification solution for ten minutes. Excess liquid was drained and the soaked wet books dried rapidly to deposit the magnesium ethyl carbonate (the carbon dioxide dissolved in the dichlorodifluoromethane carbonated the ethoxy magnesium ethyl carbonate) throughout the treated and deacidified books.

The books were deacidified and had improved aging properties. The pages were flexible and had increased strength properties. The ink was not blurred.

Various features of the invention which are believed to be new are set forth in the following claims.

What is claimed is:

1. A method for treating cellulosic materials comprising the steps of preparing a solution of a metal alkoxide in an alcohol, drying said solution to provide a dried metal alkoxide, dissolving the dried metal alkoxide in alcohol in the presence of carbon dioxide to provide a second solution, and applying the second solution to a cellulosic material.

2. A method in accordance with claim 1 wherein the metal is magnesium.

3. A method in accordance with claim 1 wherein the metal alkoxide is magnesium methoxide.

4. A method in accordance with claim 1 in which the second solution is filtered.

5. A method in accordance with claim 1 in which the metal alkoxide is magnesium ethoxide.

6. A method in accordance with claim 1 in which the metal alkoxide is dissolved in methanol.

* * * * *